US007770710B2

(12) United States Patent
Stuffel et al.

(10) Patent No.: US 7,770,710 B2
(45) Date of Patent: Aug. 10, 2010

(54) HANDRAIL COMPENSATION DEVICE

(75) Inventors: Andreas Stuffel, Bueckeburg (DE); Sameh Samdzada, Meerbeck (DE)

(73) Assignee: Otis Elevator Company, Farmington, CT (US)

( * ) Notice: Subject to any disclaimer, the term of this patent is extended or adjusted under 35 U.S.C. 154(b) by 513 days.

(21) Appl. No.: 11/630,419

(22) PCT Filed: Jul. 5, 2004

(86) PCT No.: PCT/EP2004/007331

§ 371 (c)(1),
(2), (4) Date: Dec. 22, 2006

(87) PCT Pub. No.: WO2006/002679

PCT Pub. Date: Jan. 12, 2006

(65) Prior Publication Data

US 2008/0029365 A1 Feb. 7, 2008

(51) Int. Cl.
*B66B 23/24* (2006.01)

(52) U.S. Cl. ..... 198/336; 198/330

(58) Field of Classification Search ..... 198/330, 198/336

See application file for complete search history.

(56) References Cited

U.S. PATENT DOCUMENTS 4,674,619 A 6/1987 Nakazawa et al.
5,782,333 A * 7/1998 Pitts ..... 198/336
6,460,679 B1 10/2002 Stuffel et al.

FOREIGN PATENT DOCUMENTS

JP 2001-146380 5/2001
JP 2002332184 11/2002
JP 2003182961 7/2003

OTHER PUBLICATIONS

International Search Report and Written Opinion dated Mar. 9, 2005.
International Preliminary Examination Report for PCT/EP2004/007331, dated Sep. 18, 2006.

* cited by examiner

*Primary Examiner*—Gene Crawford
*Assistant Examiner*—Kavel P Singh
(74) *Attorney, Agent, or Firm*—Carlson, Gaskey & Olds PC

(57) ABSTRACT

Method for compensating the length of a movable handrail (10) in a passenger conveyor (2) having a passenger transportation belt (4) defining at least one passenger transportation surface (8), the handrail (10) is traveling along a closed handrail path which extends through an exposed path (12) along the passenger transportation belt (4), around a turnaround means (14), through a return path (16) and around a further turnaround means (18), and which hand rail path defines a handrail plane which is substantially perpendicular to the passenger transportation surface, the method comprising the following steps: (i) turning the handrail (10) out of the handrail plane; (ii) directing the handrail (10) through a compensation means (38); and (iii) turning the handrail (10) back into the handrail plane.

12 Claims, 5 Drawing Sheets

HANDRAIL COMPENSATION DEVICE

FIELD OF THE INVENTION

The present invention relates to passenger conveyors like escalators and moving walks and particularly relates to a method for compensating a movable handrail in a passenger conveyor having a passenger transportation belt defining at least one passenger transportation surface, wherein the handrail is traveling along a closed handrail path which extends through an exposed path along the passenger transportation belt, around a turnaround means, through a return path and around a further turnaround means, and which handrail path defines a handrail plane which is substantially perpendicular to the passenger transportation surface.

DESCRIPTION OF THE RELATED ART

Such passenger conveyors are widely in use. The handrails thereof are typically made from a rubber or plastics material and are internally reinforced by reinforcing elements like reinforcing longitudinal cables which are typically made from metal material. The handrail is typically a closed loop and has a length depending of the particular application, but typically at least 30 to 35 meter. In order to compensate for manufacturing tolerances as well as shortening which occurs due to aging of the handrail, a length compensation of the handrail is typically made. To this end at least one compensation device is placed in the return path of the handrail. The manufacturing tolerances, which are substantially independent from the handrail length, are ±12.5 mm so that a length compensation of typically at least 60 mm but preferably between 60 and 75 mm or even more is desired. With existing passenger conveyors, these compensation devices consume space within the plane as defined by the handrail path. This space is, however, required for placing other components of the passenger conveyor like the passenger transportation belt guiding elements, e.g. step roller tracks, or drive elements like step chains or step chain drives. Particularly with "slim" modern passenger conveyors and particularly with class-balustrade conveyors, this space problem is acerbated. Thus, with such construction frequently the problem emerges that conventional compensation devices cannot be used due to the fact that they require too much space or a plurality of such compensation devices is required for a single handrail in order to provide sufficient compensation length.

SUMMARY OF THE INVENTION

It is the object of the present invention to provide a method and a device which obviates the space problem with the prior art passenger conveyors and which provides the designer with more flexibility for designing the arrangement of the components of the passenger conveyor in an area where space is of premium concern.

In accordance with an embodiment of the present invention this object is solved by a method as defined above including the following steps:

(a) turning the handrail out of the handrail plane;

(b) directing the handrail through a compensation means; and (c) turning the handrail back into the handrail plane.

The object is further solved with a handrail compensation device having a compensation means and a means for turning the handrail around its longitudinal axis.

By turning or twisting the handrail around its longitudinal axis, it is possible to tilt the compensating device out of the plane of the handrail path and away from that portion of the passenger conveyor where space is particularly restricted. Particularly, it is to tilt the compensation device by an angle which is sufficient for allowing the handrail in the compensation device to travel laterally past other components which are positioned within or extending into the plane as defined by the handrail path.

It is preferred to turn the handrail around its neutral longitudinal axis in order to reduce or avoid unnecessary flexing work.

Preferably the step of turning (or deflecting) the handrail out of the handrail plane comprises turning the handrail out of the handrail plane by between approximately 2° and 30° (e.g., an oblique angle). Other values particularly within this range are possible, for example between approximately 5° and 25°, between approximately 10° and 20° and between 12° and 18°.

Preferably, the handrail compensation device comprises first turning means in the moving direction of the handrail, followed by the compensation means and a second turning means. The first turning means can turn the handrail by a predetermined amount in a first direction and the second turning means can turn the handrail by the same predetermined amount in the opposite direction. Such a construction shows that the handrail moves in exactly the same direction before and after the compensation device. It is also possible to not turn the handrail in one single step by the desired amount but to provide a plurality of turning means for even a continuous turning means over a prolonged distance in order to achieve a predetermined turning angle.

Preferably, the turning means comprises a first and second guide roller sets each for contacting the handrail on its upper side, i.e. the side which is to be contacted by the user, and its inner side, i.e. the side which faces away from the upper side wherein the second guide roller set is angularly offset with respect to the first guide roller set so that in use the handrail is turned while traveling from the first to the second guide roller set. Each guide roller set preferably forms a slit or nip through which the handrail passes. The angular difference between the first slit and the second slit defines the angular offset and consequently the handrail turning angle. Instead of the guide roller sets any other guiding elements like sliding contact plates or moving contact belts can be used. It is preferred that such alternative guide means also form a slit or nip for guiding the handrail.

Preferably, the second roller set comprises two inner rollers on that side which in use is adjacent to the inner side of a generally C-shaped handrail, said two inner rollers are arranged with its rotational axis substantially perpendicular to each other so that in use one of the inner rollers will contact the lateral legs of the C-shaped handrail while the other inner roller will contact the web between the legs. In order to provide for a secure guidance of the inner side of the handrail, a single roller needs a relatively large diameter which might collide with space requirements. In order to obviate this problem, an embodiment of the invention suggests using one roller or disc which has a diameter slightly smaller than the distance between the two legs of the C-shaped handrail and using a further roller whose circumferential surface contacts the web portion between the two legs and which may have a relatively small diameter. This double roller arrangement can be constructed in a way that it is only slightly extending above the thickness of the handrail.

Preferably, the first and second roller sets are spaced from each other by a distance that is at least two times the width of the handrail. The distance between the first and second roller sets corresponds to the length through which the handrail is turned around its longitudinal axis. It is preferred to turn the handrail in a way that the lateral legs of the C-shaped handrail do not flex or flex only at a minimum amount. This will avoid aging of the handrail due to flexing work. In order to avoid this aging, a predetermined distance is provided between the first and second roller sets.

Preferably, the compensation means comprises a compensation roller, in use acting against the inner side of the handrail and bulging the handrail in the direction of the upper side thereof, and wherein the second roller set is offset by a predetermined distance from the first roller set in a direction opposite to the bulging direction of the compensation roller. With such a construction the handrail is—as viewed from the side—first directed upward between the first and second roller sets and subsequently directed downward by the compensation roller before it is directed back to the second roller set of the return turning device and again downward towards its original direction. With such a construction a particularly compact compensation device can be realized.

An embodiment of the invention further relates to a passenger conveyor having a passenger transportation belt defining at least one passenger transportation surface and a movable handrail which is traveling along a closed handrail path extending through an exposed path along the passenger transportation belt, around a turnaround means, through a return path, and around a further turnaround means, and defining a handrail plane which is substantially perpendicular to the passenger transportation surface, further comprising a compensation means and a means for turning the handrail around its longitudinal axis. The turning means does not necessarily have to be a part of the compensation device, but can be located at other positions, preferably along the return path of the handrail. One might contemplate to guide the handrail over an extended distance in a tilted manner and possibly out of the plane of the handrail path and to position the compensation means in such portion.

Preferably, the passenger conveyor comprises a compensation device according to an embodiment of the invention.

Preferably, some or all components of the compensation device are mounted to a support element, for example a support plate. Such support element can be mounted with the predetermined turning angle in the passenger transportation device. By providing virtually all the components on the single support element, these components can be aligned with ease in the factory and can easily be assembled in the conveyor, for example attached to the conveyor trust, etc. without the need for mounting and aligning the components individually.

Preferably, the components of the compensation device or alternatively the support element are/is attached to precisely aligned components of the passenger transportation device. Such precisely aligned components can for example be the step roller tracks, the chain roller tracks, the balustrade holder, etc. By providing a suitable mounting arrangement, for example mating surfaces, specific fasteners, etc. it is possible to design the passenger conveyor in a way that the components of the passenger transportation device are precisely aligned by merely securing it to the respective aligned components. Such a design can substantially reduce the efforts for assembling the passenger conveyor.

BRIEF DESCRIPTION OF THE DRAWINGS

The invention and embodiments of the invention are described in greater detail below with reference to the Figures, wherein.

DETAILED DESCRIPTION

Figure 1:
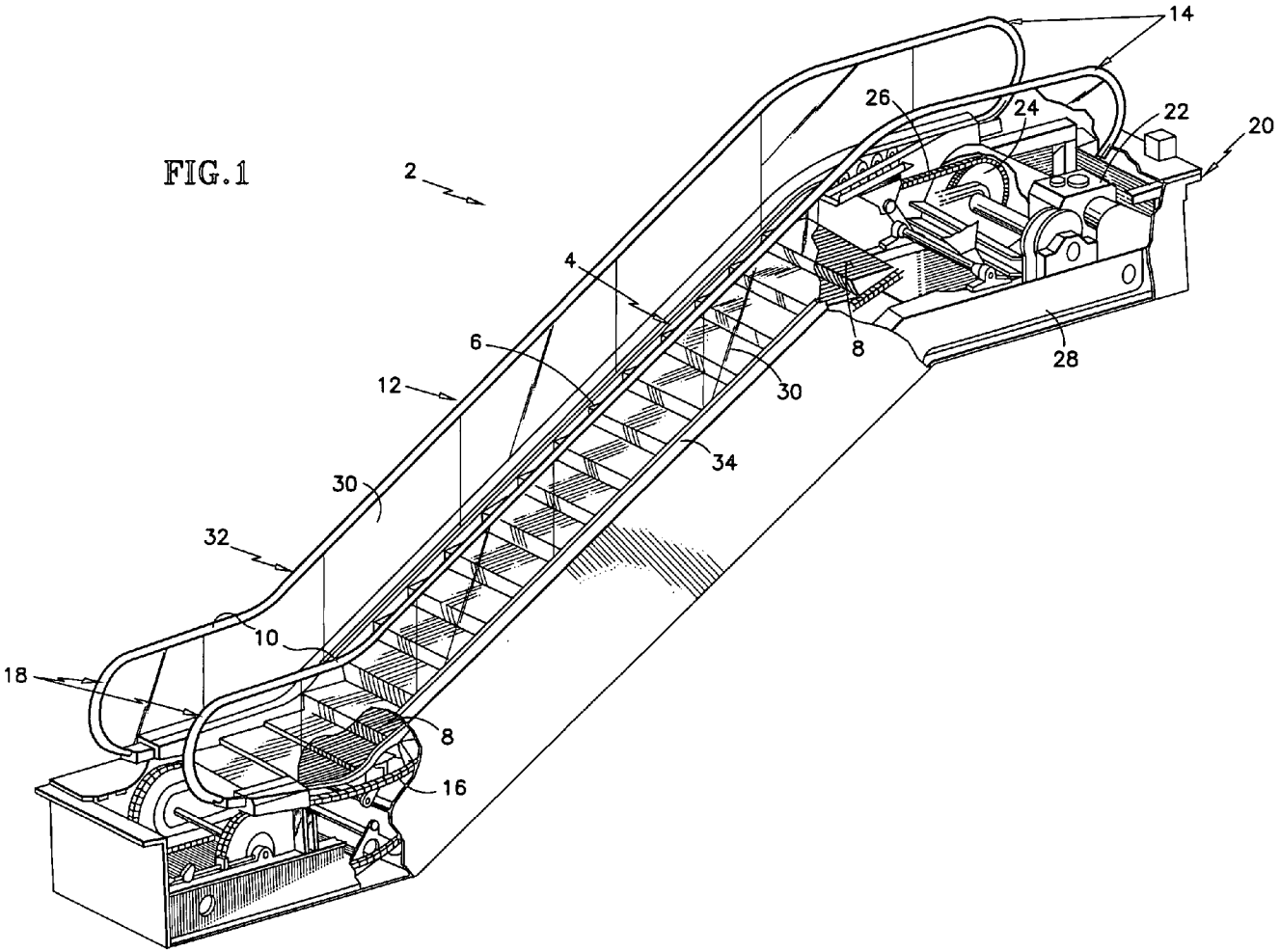
FIG. 1 shows a passenger conveyor.

FIG. 1 shows a passenger conveyor 2 and particularly an escalator having a passenger transportation belt 4 comprised of a plurality of steps 6, the treats thereof form a plurality of passenger transportation surfaces 8. The escalator 2 further comprises two movable handrails 10. Each handrail 10 is traveling along a closed handrail path which extends through an exposed path 12 where the handrail 10 is exposed to the passengers and travels in parallel to the passenger transportation surfaces 8. The closed handrail path further comprises a upper turnaround means 14, a return path 16 which is nearly completely covered in the Figure and runs below the passenger transportation belt 4, and a lower turnaround means 18. The turnaround means 14 and 18 are frequently termed newels. The escalator 2 further comprises a truss 20 for mounting the escalator in the building and for supporting escalator components like an escalator drive 22, a chain drive sprocket 24 driving the escalator chain 26 and step roller tracks 28. The person skilled in the art will understand that in the perspective view of FIG. 1 some parts of the escalator 2 are broken away for showing details which would otherwise be hidden.

In FIG. 1 also the glass panels 30 of the lateral balustrades 32 are shown. The glass panels 30 are at the lower end thereof supported by a glass holder profile 34 and support at their upper end a (not shown) handrail guide profile. The closed handrail path defines a handrail plane which substantially coincides with the glass panels 30 and which is substantially perpendicular to the passenger transportation surfaces 8 and extending in a vertical direction, respectively.

Figure 2:
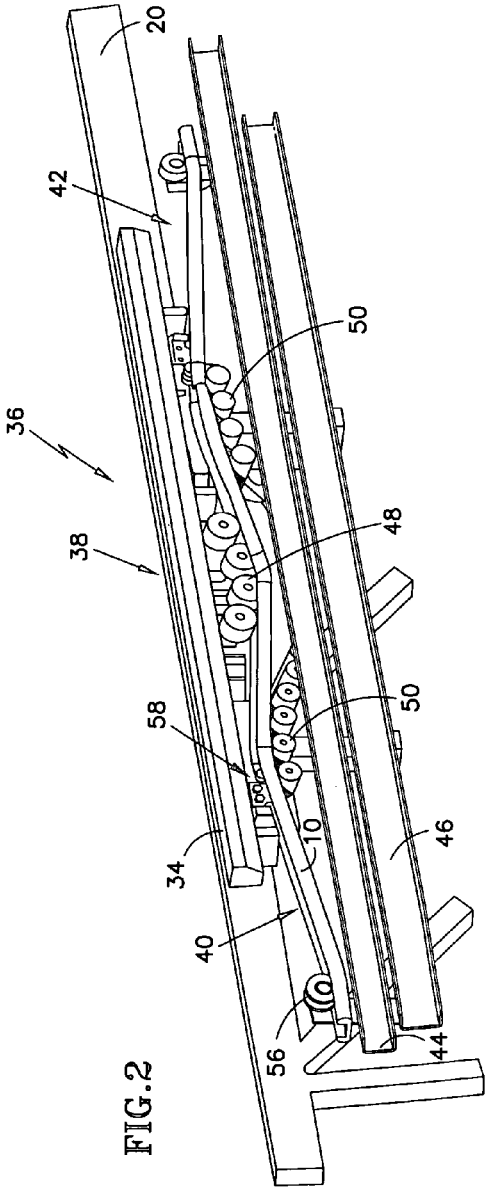
FIG. 2 shows a compensation device in accordance with an embodiment of the invention with minimum compensation in perspective view.

FIG. 2 shows a perspective view of a handrail compensation device 36 in accordance with an embodiment of the invention. The handrail compensation device 36 includes a handrail compensation means 38 as well as a first twisting or turning means 40 and a second twisting or turning means 42.

FIG. 2 further shows part of the truss 20 and the glass holder profile 34. A step roller track 44 and a step chain roller track 46 are also visible in FIG. 2. The handrail compensation means 38 comprises a compensation bow 48 including a plurality of compensation bow rollers as well as two back bending roller bows 50 which also comprise a plurality of back bending rollers.

Figure 5:
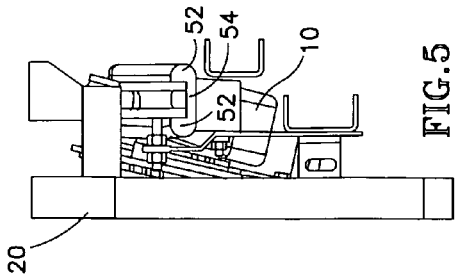
FIG. 5 shows an end view of the compensation device of FIG. 4 with maximum compensation.

One can further see that the handrail 10 generally is of C-shaped cross section having two lateral legs 52 protruding away from a central web 54 (see FIG. 5).

The first and second turning means 40, 42 are each shown as comprising a first 56 and a second 58 guide roller sets. The first and second guide roller sets 56, 58 each define a slit or nib through which the web 54 of the handrail 10 is guided. The extension of the slit with the guide roller set 56 is perpendicular to the plane as defined by the handrail path. The slit of the second roller set 58 is angled with respect thereto by a predetermined amount which finally defines the twist or turning amount of the handrail. The second guide roller set 58 may comprise one or more rollers of the back bending roller bow 50.

Figure 4:
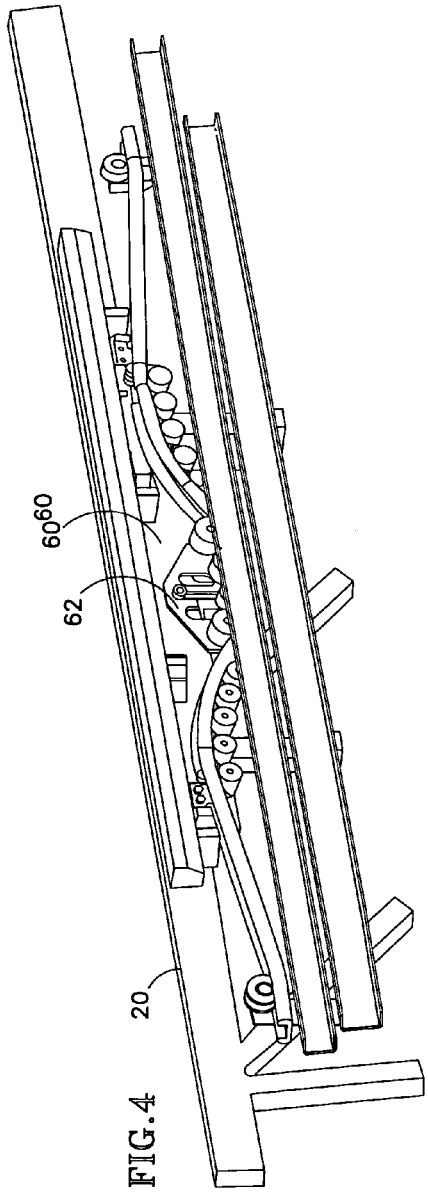
FIG. 4 shows a compensation device in accordance with an embodiment of the invention in perspective view similar to that of FIG. 2, but in the state of maximum compensation.

As may be seen by comparing FIGS. 2 and 4, the compensation bow 48 can be varied between a minimum compensation position as shown in FIG. 2 and a maximum compensation position in FIG. 4. One can further see in FIG. 4 a supporting element 60 in the form of a support plate. The holder 62 for the compensation bow is slidingly attached to the support plate 60.

Figure 3:
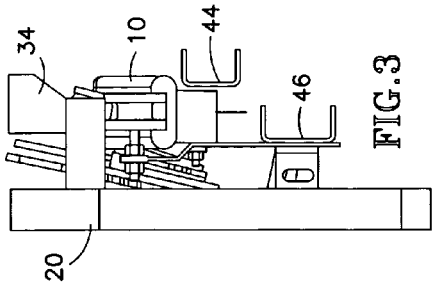
FIG. 3 shows an end view of the compensation device of FIG. 2 with minimum compensation.

FIGS. 3 and 5 show end views of the handrail compensation device 36 as shown in FIGS. 2 and 4, respectively. One can particularly see in FIG. 3 that the handrail 10 would collide with the step roller track 44 if the compensation device 38 would simply bend it downward as it was conventional with the prior art. There is only limited space between the handrail 10 and the upper portion of the step roller track 44, which is not sufficient for providing the required compensation. One can clearly see in FIG. 5 that due to the twisting or turning of the handrail and the tilted arrangement of the compensation means 38 sufficient compensation can be provided due to the fact that the handrail 10 passes laterally by the step roller track 44. Thus FIGS. 3 and 4 illustrate clearly how an embodiment of the invention solves the space-related problems which are inherent with the compensation devices of the prior art.

Figure 6:
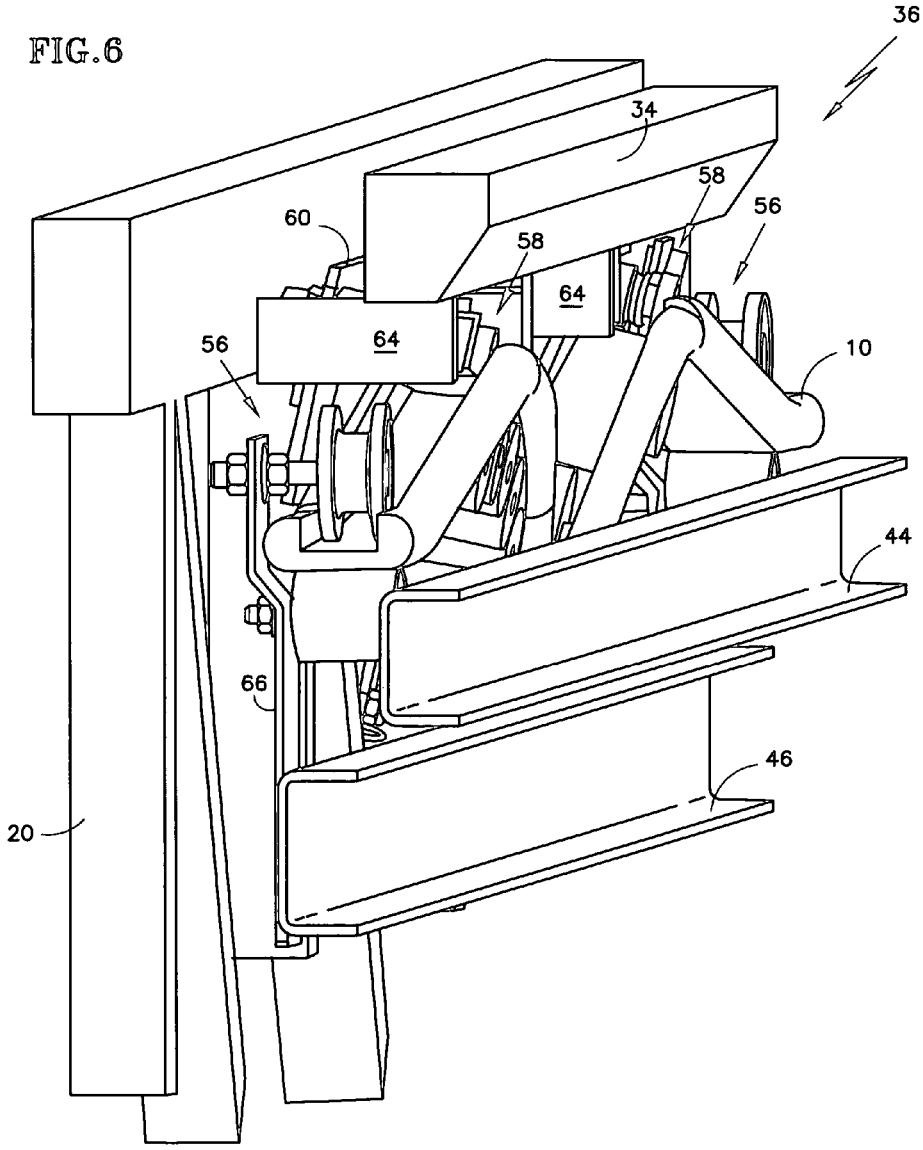
FIG. 6 shows a perspective view of the compensation device in accordance with an embodiment of the invention as attached to the components of the passenger conveyor.

FIG. 6 is a further perspective view of the handrail compensation device 36 similar to that of FIG. 4 with the compensation being near maximum. In FIG. 6 one can clearly see the handrail which is twisted between the first guide roller set 56 and the second guide roller set 58. One can further see in FIG. 6 that the handrail 10 is first directed upward from the first guide roller set 56 to the second guide roller set 58 before it is directed downward through the compensation bow and then up again to the second guide roller set 58 of the second turning means which directs the handrail 10 down again and back again in its original direction.

FIG. 6 again shows parts of the truss 20 as well as the glass holder profile 34 and the step roller track 44. It is to be noted that the glass holder profile 34 and the step roller track 44 are components of the escalator 2 which are very precisely aligned. Accordingly, by fixing the handrail compensation device 36 to one and/or the other of those parts, a perfect alignment thereof can achieved without the need for individual alignment of the handrail compensation device and/or its individual components. Beams 64-which are attached to the support plate 60 attach the handrail compensation device 36 to the glass holder profile 34. A holder 66 for the first guide roller set 56 is attached to the step chain roller profile 48.

Figure 7:
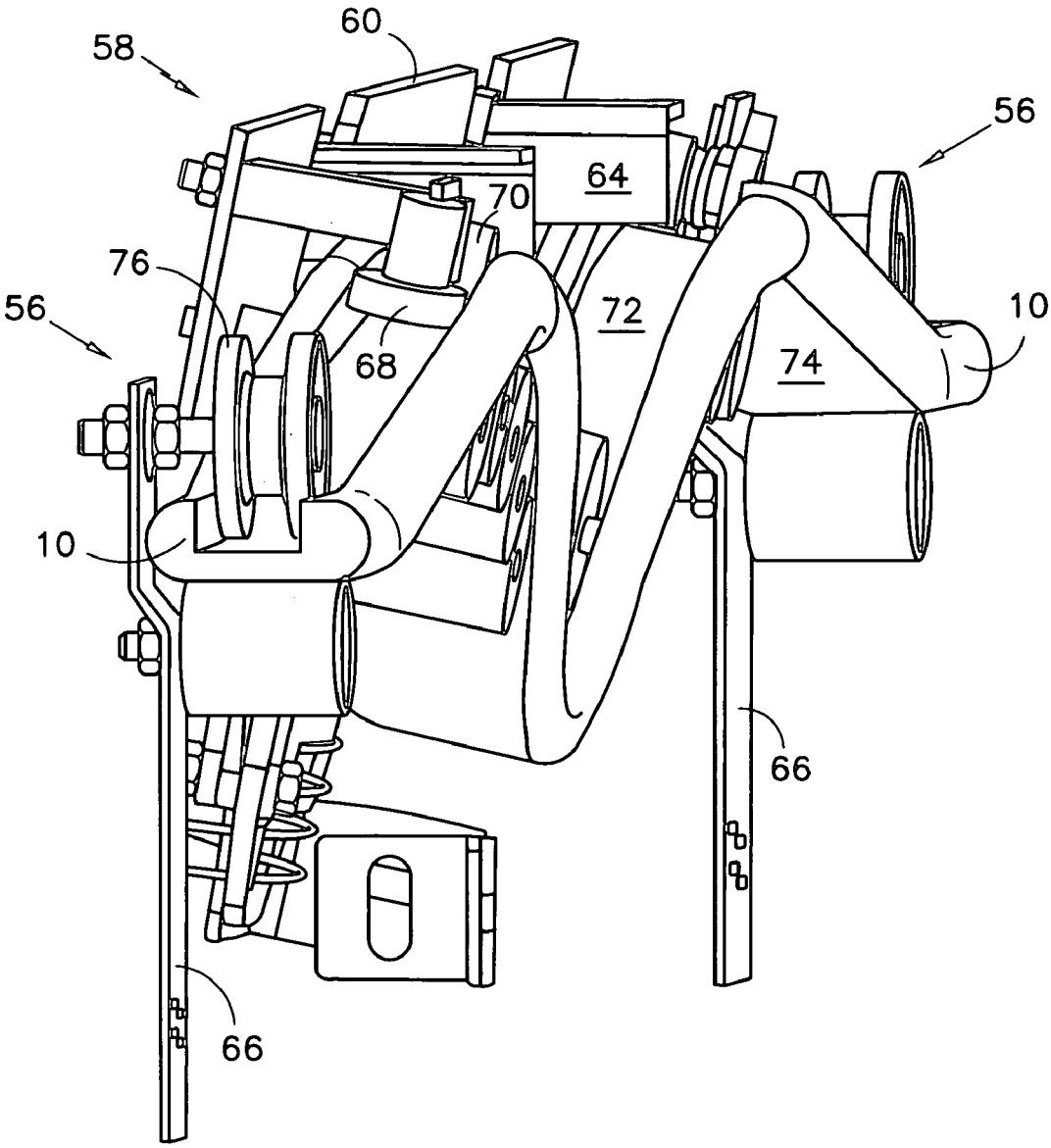
FIG. 7 shows a similar view to that of FIG. 6 of the compensation device, but without the remainder of the passenger conveyor.

FIG. 7 is a view similar to that of FIG. 6, but with the components beyond the handrail compensation device 36 being omitted. In this view the second roller set 58 is better visible than in the previous Figures. One can particularly see that the second roller set 58 comprises two inner rollers 68 and 70. These inner rollers 68 and 70 contact the inner side 72 of the handrail 10. The inner side 72 of the handrail 10 is opposite to the upper side 74 or outer side, which is exposed to the passengers in the portion of the handrail path along the passenger transportation belt. One can particularly see that the two inner rollers 68 and 70 are arranged with its rotational axis substantially perpendicular to each other so that in use the disc-shaped inner roller 68 contacts the lateral legs 52 of the C-shaped handrail 10 while the other inner roller 70 which has the form of a cylindrical roller, contacts the web 54 between the legs 52. The disc 68 has a slightly smaller diameter than the distance between the two legs so that it guides either one or the other leg 52. Accordingly, the two inner rollers 68, 70 require by far less height than the conventional inner roller 76 in the first guide roller set 56. This allows for directing the handrail upward between the first and second guide roller sets 56, 58 despite the space restriction imposed by the presence of the overlaying glass holder profile 34 (see FIG. 6).

Figure 8:
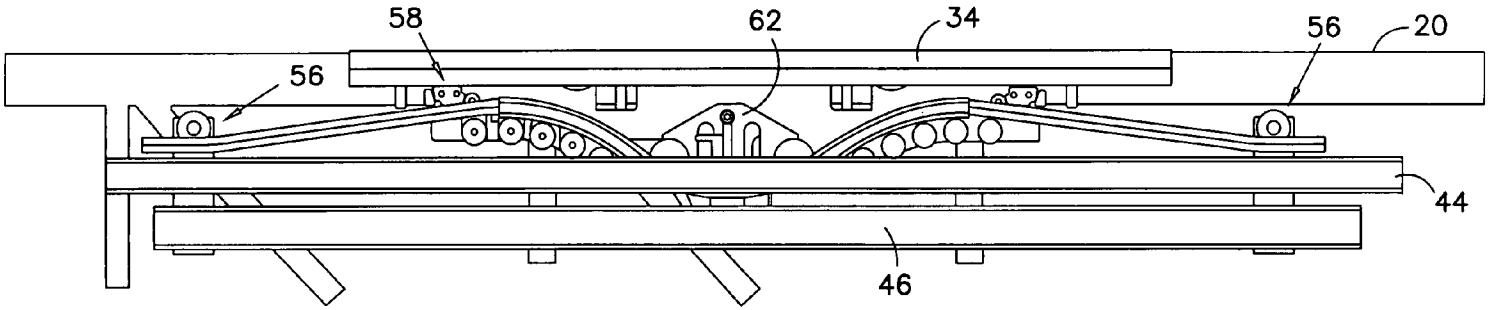
FIG. 8 shows a side view of the compensation device in accordance with an embodiment of the invention as attached to components of the elevator conveyor.
Figure 9:
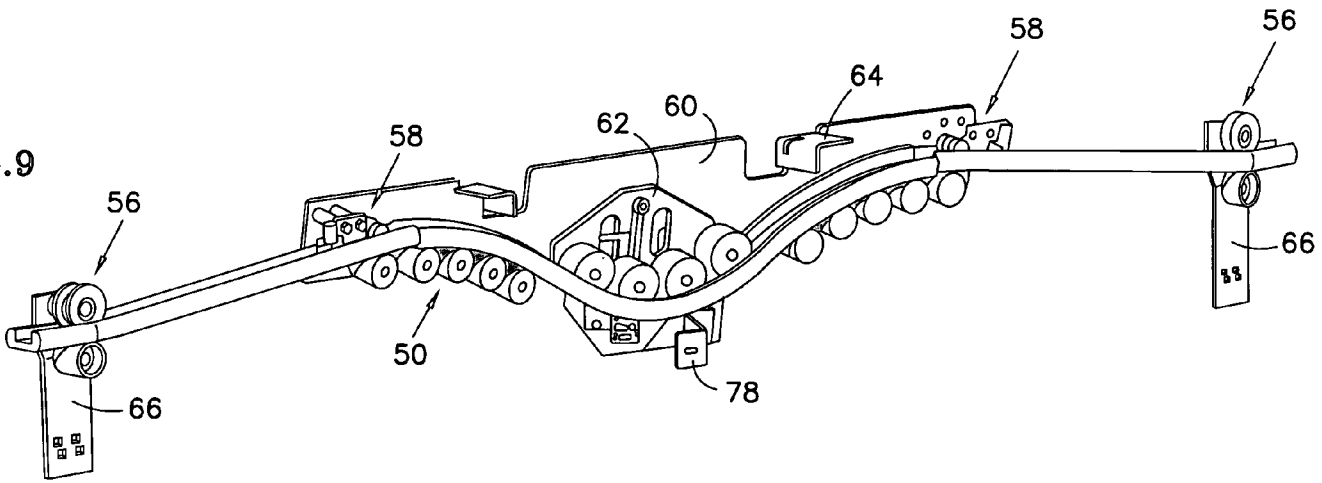
FIG. 9 shows a perspective view of the compensation device without surrounding components.

FIG. 8 is a side view of the handrail compensation device 36 according to an embodiment of the invention which illustrates the restricted space between the second guide roller set 58 and the glass holder profile 34. FIG. 9 illustrates the fixation points for the handrail compensation device. One can see that with the exception of the first guide roller set 56 all components are fixed to the support plate 60 which is secured to the underside of the glass holder profile 34 by way of the beams 64 and which is further supported by way of the support 78 to either of the two guide rails 44, 46, but preferably to the step chain roller track 46. Thus, by way of fixing the support plate 60 at three fixation points, its fixation is statically defined. The first guide roller sets 56 are each individually attached by way of holder 66 to the step chain roller track 46.

The invention claimed is:

1. A device for use with a passenger conveyor handrail that follows a loop having an exposed path vertically aligned with a return path, the device comprising:

a deflecting member that is configured to deflect a portion of the handrail along the return path out of vertical alignment with the exposed path;

a second deflecting member that is configured to deflect the portion of the handrail back into vertical alignment with the exposed path, the second deflecting member being spaced from the first deflecting member; and a compensation device positioned between the first and second deflecting members.

2. The device of claim 1, wherein the first deflecting member is configured to cause a guidance following surface of the deflected portion of the handrail to be at an oblique angle relative to a vertical plane that passes through each of the exposed path and the return path.

3. The device of claim 2, wherein the oblique angle is between 2° and 30°.

4. The device of claim 1, wherein the deflecting member is configured to turn the portion of the handrail about a longitudinal axis of the handrail.

5. The device of claim 1, wherein the deflecting member is configured to twist the portion of the handrail about a longitudinal axis of the handrail.

6. The device of claim 1, wherein a vertical plane passes through each of the exposed path and the return path and the compensation device is configured to urge the deflected portion away from the vertical plane along an oblique angle relative to the vertical plane.

7. The device of claim 1, wherein the deflecting member comprises a plurality of guide rollers positioned to contact the handrail on opposite sides of the handrail, at least one of the guide rollers being angularly offset relative to another of the guide rollers so that the handrail is turned while traveling between the one and another guide rollers.

8. The device of claim 7, comprising two of the guide rollers being positioned to contact one side of the handrail and wherein the two of the guide rollers rotate about axes that are perpendicular to each other.

9. The device of claim 8, wherein the two rollers are positioned to contact different surfaces of a guidance following side of the handrail.

10. A device for use with a passenger conveyor handrail that follows a loop having an exposed path vertically aligned with a return path, the device comprising:

a deflecting member that is configured to deflect a portion of the handrail along the return path out of vertical alignment with the exposed path;

a second deflecting member spaced from the deflecting member a distance that is at least two times a width of the handrail.

11. A passenger conveyor, comprising:

a moving surface configured to carry a passenger;

a handrail that moves with the moving surface along a loop that includes an exposed path and a return path, a segment of the handrail along the exposed path being vertically aligned with a segment of the handrail along the return path;

a deflecting member positioned to deflect a portion of the handrail along the return path out of vertical alignment with the segment of the handrail along the exposed path; and a second deflecting member that is configured to deflect the portion of the handrail back into vertical alignment with the segment of the handrail along the exposed path, the second deflecting member being spaced from the first deflecting member; and a compensation device positioned between the first and second deflecting members.

12. The passenger conveyor of claim 11, wherein a vertical plane passes through each of the exposed path and the return path and the compensation device is configured to urge the deflected portion away from the vertical plane along an oblique angle relative to the vertical plane.

* * * * *

UNITED STATES PATENT AND TRADEMARK OFFICE

CERTIFICATE OF CORRECTION

PATENT NO. : 7,770,710 B2
APPLICATION NO. : 11/630419
DATED : August 10, 2010
INVENTOR(S) : Andreas Stuffel It is certified that error appears in the above-identified patent and that said Letters Patent is hereby corrected as shown below:

Title Page, Item (75) the "Inventor" section should read as follows:

Andreas Stuffel, Bueckeburg (DE);
Sameh Samadzada, Meerbeck (DE)

Signed and Sealed this

Twelfth Day of October, 2010

David J. Kappos

David J. Kappos
*Director of the United States Patent and Trademark Office*